US008047276B2

(12) United States Patent
Stamoulis

(10) Patent No.: US 8,047,276 B2
(45) Date of Patent: Nov. 1, 2011

(54) TOOL FOR ENHANCING THE EXTRACTION OF LANDFILL GAS

(76) Inventor: Stefan Stamoulis, Alvin, TX (US)

( * ) Notice: Subject to any disclaimer, the term of this patent is extended or adjusted under 35 U.S.C. 154(b) by 0 days.

(21) Appl. No.: 12/780,102

(22) Filed: May 14, 2010

(65) Prior Publication Data

US 2011/0061874 A1 Mar. 17, 2011

Related U.S. Application Data

(63) Continuation-in-part of application No. 12/558,203, filed on Sep. 11, 2009, now Pat. No. 7,866,921.

(51) Int. Cl.
*E21B 43/112* (2006.01)

(52) U.S. Cl. ..... 166/55.2

(58) Field of Classification Search ..... 166/55.2, 166/55.1, 55

See application file for complete search history.

(56) References Cited

U.S. PATENT DOCUMENTS

| | | | | |
|---|---|---|---|---|
| 2,171,442 | A | | 8/1939 | Bynum |
| 2,482,913 | A | | 9/1949 | Jobe |
| 2,526,695 | A | * | 10/1950 | Schlumberger ..... 166/55.1 |
| 2,612,346 | A | * | 9/1952 | Nelson ..... 175/77 |
| 2,884,066 | A | * | 4/1959 | Teplitz et al. ..... 166/55 |
| 2,974,727 | A | | 3/1961 | Goodwin |
| 4,442,901 | A | | 4/1984 | Zison |
| 4,469,176 | A | | 9/1984 | Zison et al. |
| 4,768,899 | A | * | 9/1988 | Dysarz ..... 405/195.1 |
| 5,701,958 | A | | 12/1997 | Braziel |
| 6,338,386 | B1 | | 1/2002 | Catania et al. |
| 6,990,879 | B2 | | 1/2006 | Rubino |
| 7,387,163 | B2 | | 6/2008 | Seegers et al. |
| 2007/0062701 | A1 | | 3/2007 | Seegers |

FOREIGN PATENT DOCUMENTS

WO PCT/US2010/048402 9/2010

OTHER PUBLICATIONS

James D. Bier et al.; Effects of Landfill Gas Management at the Industry Hills Recreation & Conference Center; SWANA 17th Annual Landfill Gas Symposium; Mar. 22-24, 1994.

Paul J. Stout; Effects of liquid Removals from Landfills on Increasing Leg Flow Rates; 12th Annual Waste Recreation & 5th Annual Collection/Transfer Symposium; Feb. 12-17, 2001.

Bryan A. Stirrat & Ass.; The Influence of Design & Construction on the Performance of Landfill Gas Extraction Wells; SWANA 27th Annual Landfill Gas Symposium; Mar. 22-25, 2004.

Dean Voelker; Landfill Gas Collection System Design & Operation in a Wet Landfill; SWANA 28th Landfill Gas Symposium; Mar. 7-10, 2005.

* cited by examiner

*Primary Examiner* — John Kreck
(74) *Attorney, Agent, or Firm* — Boulware & Valoir

(57) ABSTRACT

An apparatus and method to internally provide apertures inside polyvinyl chloride (PVC), high density polyethylene (HDPE), or any polymeric pie, plastic pipe-riser (blank casing) in existing landfill gas recovery wells (extraction wells) that have been installed at Municipal Solid Waste Facilities are described. By creating additional apertures in landfill gas recovery well risers, landfill gas derived from the decomposition of waste is allowed to enter the existing riser and extraction/recovery system. This process saves time and cost associated with drilling additional wells to capture landfill gas from subsequent layers of the waste body. The process assists in maintaining regulatory compliance by capturing landfill gas and preventing it from being emitted into the atmosphere.

16 Claims, 7 Drawing Sheets

Graphic Representation of the Structure of Typical Placement of an Original Methane Gas Recovery Well with Subsequent Extensions of Riser to Final Grade at a MSWF.

Not to Scale

Landfill Design Schematic

Not to Scale

Graphic Representation of Decompositional and Structural Zones of a Typical Methane Gas Recovery Well at a MSWF.

Not To Scale

Carrier Unit Track (50) Schematic

TOOL FOR ENHANCING THE EXTRACTION OF LANDFILL GAS

PRIOR RELATED APPLICATIONS

This application is a continuation-in-part of U.S. patent application Ser. No. 12/558,203 filed on Sep. 11, 2009, now U.S. Pat. No. 7,866,921 which is incorporated by reference in its entirety.

FEDERALLY SPONSORED RESEARCH STATEMENT

Not applicable.

REFERENCE TO MICROFICHE APPENDIX

Not applicable.

FIELD OF THE INVENTION

The invention is a tool, system and method for providing openings or apertures internally through a polymeric pipe and a method of using the tool to improve landfill gas (LFG) extraction from LFG recovery wells at municipal solid waste facilities (MSWF). The method uses an internal pipe aperture tool to create openings or holes in existing riser pipe to extract additional LFG there through from LFG recovery wells at MSWF. By providing apertures in the LFG well riser pipes, the volume and rate of LFG extraction is enhanced, the amount of LFG extracted from a given landfill unit is increased and less LFG is emitted into the atmosphere. Increasing LFG capture and production while reducing LFG emissions assists MSWF in maintaining regulatory compliance. Additionally, the tool can be used to rehabilitate LFG recovery wells where the screen zone in the pipe that has the openings to allow landfill gas extraction has been flooded, clogged or otherwise rendered inoperable. The internal pipe aperture tool can be used in LFG recovery wells that have been extended above the original riser after waste has been added to the landfill.

BACKGROUND OF THE INVENTION

Methane is a primary constituent of landfill gas (LFG) and a potent contributor to greenhouse gasses. MSWF are the largest source of human-related (anthropogenic) methane emissions in the United States. In 2004, for example, MSWF accounted for about 25 percent of the methane emissions in the United States. Additionally, escaping LFG emissions are a lost opportunity to capture and use a significant energy source. Substantial economic and environmental benefits are achieved by capturing LFG prior to release, while subsequently reducing greenhouse gasses. LFG capture projects improve energy independence while lowering energy costs, contribute to the creation of jobs, and help local economies. LFG is currently recovered from landfills using a series of wells and a vacuum system that consolidates the collected gas for transportation and processing. LFG is then used for a variety of purposes including, but not limited to, motor vehicle fuel, generator fuel, biodiesel production, natural gas supplement, as well as and a green power source.

Currently, MSWF bury waste in layers in excavations over time (See FIG. 1A). The basic structure is a floor and sidewalls of compacted clay, typically covered with a high density polyethylene (HDPE) polymer liner, filled with layers of waste alternated with clay or soil layers covering the waste layers (See FIG. 1B). Once a landfill has reached a certain capacity, LFG recovery wells are installed and LFG is extracted from the decay and decomposition of waste layers. The original pipe which is placed in the LFG recovery well has a perforated end so that LFG can be recovered. The perforated end is sometimes referred to as a screen section. The perforated end or screen section may have holes drilled into it or slots cut into it. As the waste in the landfill increases in height, non-apertured "riser pipe", "pipe", "casing", "riser", "extended riser", or "vertical pipe" is added to the existing well. These terms may be used interchangeably for the tubular members extending into the waste body and includes tubular members that are perforated to form a screen section. Once the waste body reaches the design height or capacity it is covered with compacted soil, topsoil, or in some cases liner material and the surface is subsequently replanted with natural vegetation and the waste body left to decompose. LFG is created as the organic fraction of solid waste decomposes in a landfill. LFG consists of about 50 percent methane ($CH_4$), the primary component of natural gas, about 40-49% percent carbon dioxide ($CO_2$), and a small amount of non-methane organic compounds. Landfills must be monitored over time to ensure that LFG emissions, leachate, and waste from the solid waste unit are not being released and impacting the environment. Methane extraction and recovery captures LFG and prevents or decreases emission of these air contaminants. LFG is first produced in the older, lower levels of decomposing waste bodies. Subsequent layers of waste produce LFG at different times and rates. Currently, to recover LFG from these additional layers, wells are drilled to a desired depth or elevation and LFG is extracted using a vacuum system. If not captured, the LFG escapes through the landfill cap and into the atmosphere. As decomposition continues, shallower wells are required to capture LFG generated in the upper waste bodies (See FIG. 1C). This is currently accomplished by the advancement of new wells into the upper waste bodies, which can be a capital intensive process.

Captured LFG can be used for energy generation to produce electricity with engines, turbines, microturbines, or similar technologies. LFG is also used as an alternative to fossil fuels and can be refined and injected into a natural gas pipeline. The capture and application of LFG in these ways yields substantial energy, economic, environmental, and public health benefits. Internationally, significant opportunities exist for the expansion and increase of LFG recovery and use while reducing harmful emissions of greenhouse gases. LFG recovery and use is a reliable and renewable fuel option that represents a largely untapped and environmentally friendly energy source at thousands of landfills in the United States and abroad.

Traditional attempts to enter non-functional or under-producing methane recovery wells for rehabilitation purposes have been unsuccessful for many various reasons. For example, such wells are often on side slopes or uneven ground which makes access to the wells with traditional equipment (i.e. a drill rig) very difficult and sometimes impossible. Additionally, the pipes used for such wells in MSWF are made from a material that often bends and deviates after well installation and during waste placement resulting in wells that are no longer vertical. This makes traditional re-entry attempts very difficult. Couplers, lag screws, or similar type fasteners used to connect additional pipes or risers generate obstructions inside the wells, making re-entry near impossible at depths necessary for successful well rehabilitation. These reasons among others severely limit the available methods to successfully rehabilitate a methane gas recovery well. Since at least 1993, the need to rehabilitate existing LFG recovery wells has been a recognized unsolved problem. An internal pipe aperture tool and a method of use is needed to successfully re-enter and rehabilitate flooded, clogged, obstructed, and otherwise rendered inoperable LFG recovery wells as well as adding apertures to riser pipe that has been added on to existing LFG recovery wells.

SUMMARY OF THE INVENTION

Embodiments of the invention provide a tool, method and system for extracting LFG from an LFG recovery well typically located in municipal solid waste facilities (MSWF). The tool can be used to generate apertures within the screen interval of an existing landfill gas recovery well, within the existing riser pipe including riser pipe with screens, and within additional riser pipe added to a landfill gas recovery well. The tool is also safely and successfully operable within casings adjacent to various environments including, but not limited to, soil, rock, and waste. The invention is designed to provide apertures in conditions that include non-vertical wells, wells with internal obstructions, explosive conditions and wells containing fluid.

In some embodiments, the tool includes: (a) a housing sized to be placed within the internal diameter of a LFG recovery well casing; (b) one or more pistons positioned inside the housing capable of extending from the housing positioned inside the LFG recovery well casing to create an aperture through the LFG recovery well casing; and (c) passages in the housing to the piston to provide motive fluid to actuate the pistons to extend from the housing and create an aperture in the well casing and subsequently retract the piston into the housing. An attachment on the tool is used to connect to a cable or equivalent to lower and raise the tool in and out of the well. The motive fluid may provide a pressure that may range from about 1000 to about 3500 psi. In some embodiments, the aperture is generally circular with a diameter that may range from about % inch to about 1 inch. If desired, more than one tool can be connected to create a series of tools to generate additional apertures during operation in the well casing. The LFG recovery well casing may have an outer diameter of approximately 4 inches to approximately 8 inches. In some embodiments, a carrier maneuvers the tool into the LFG recovery well casing and provides the motive fluid to the tool. The motive fluid may be hydraulic, pneumatic, or fossil fuel, such as, but not limited to diesel, hydraulic fluid, compressed air, or other non-sparking motive fluid. In various embodiments, the carrier comprises a truck and trailer, a tractor which can pull a trailer, or a small track mounted unit and may be a radio controlled unit or a self propelled unit. The tool can be transported through sloped and other difficult terrain to the well site.

In some embodiments, the method of producing landfill gas from an existing LFG recovery well includes: (a) positioning the aperture tool within the internal diameter of the LFG recovery well casing, said aperture tool comprising a housing, one or more pistons positioned inside the housing capable of extending from the housing to create an aperture through the LFG recovery well casing, passages in the housing to the piston to provide motive fluid; (b) providing motive fluid to the piston of the aperture tool to create apertures through the LFG recovery well casing with a pressure ranging from about 1000 to about 3500 psi, and (c) extracting LFG after the apertures are created in the well casing. In most embodiments, the LFG recovery well casing is a polymer and the tool must operate to create apertures in the polymer pipe. The steps may be repeated in more than one landfill gas recovery well casing. In some embodiments, the landfill gas collection is necessary to ensure the MSWF meets the federal compliance standards: New Source Performance Standards (NSPS) 40 *CFR Part* 60, *Subparts Cc and WWW.*

In some embodiments, a system for enhancing the recovery of LFG from a LFG recovery well includes: (a) a mobile carrier; (b) a portable aperture tool for creating openings in a LFG recovery well casing movable to a LFG recovery well by the mobile carrier which positions the portable tool within the LFG recovery well casing at the desired depth; (c) said portable tool comprises a housing with at least one piston for creating an aperture by extending the piston through the casing in the LFG recovery well; (d) a passage for motive fluid between a reservoir outside the recovery well casing and the piston; and (e) a pressure creating means for operating motive fluid to force the piston against the internal wall of the recovery well casing to create an aperture there through for flow of LFG. In some embodiments, the mobile carrier also includes leveling mechanisms and control mechanisms for operating the portable aperture tool and a winch for positioning the portable tool within the LFG recovery well casing at the desired depth.

The tool, system and method is designed to operate in a variety of conditions associated with LFG recovery wells located at MSWF facilities to provide efficient and effective recovery of LFG by creating apertures in the existing pipe as described in this summary and further in the specification.

DESCRIPTION OF EMBODIMENTS OF THE INVENTION

Figure 1A:
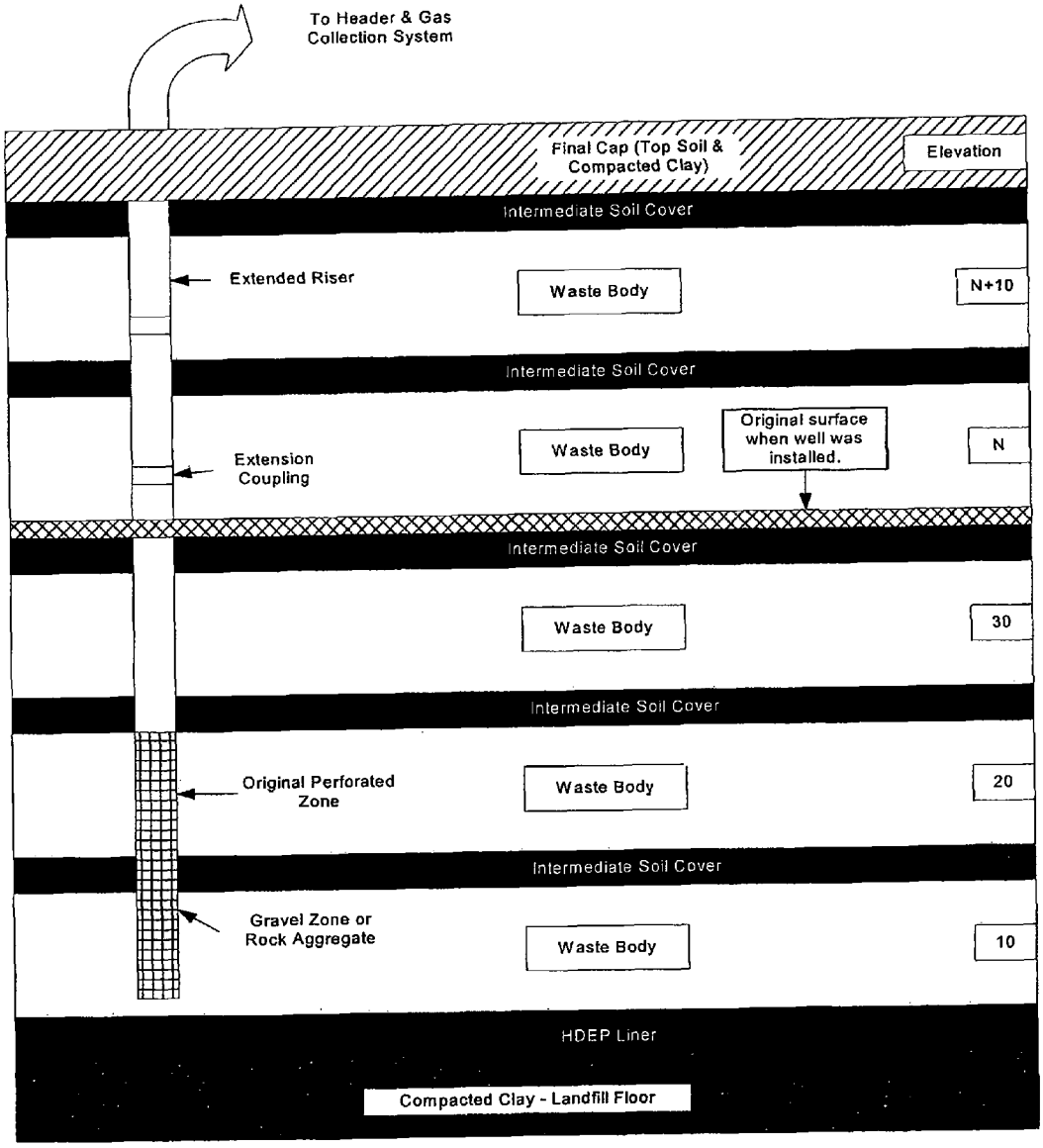
FIG. 1A is a graphic representation of an embodiment of an LFG recovery well having original perforations/apertures in the riser pipe along with extended riser placed after the original placement and installation.
Figure 1B:
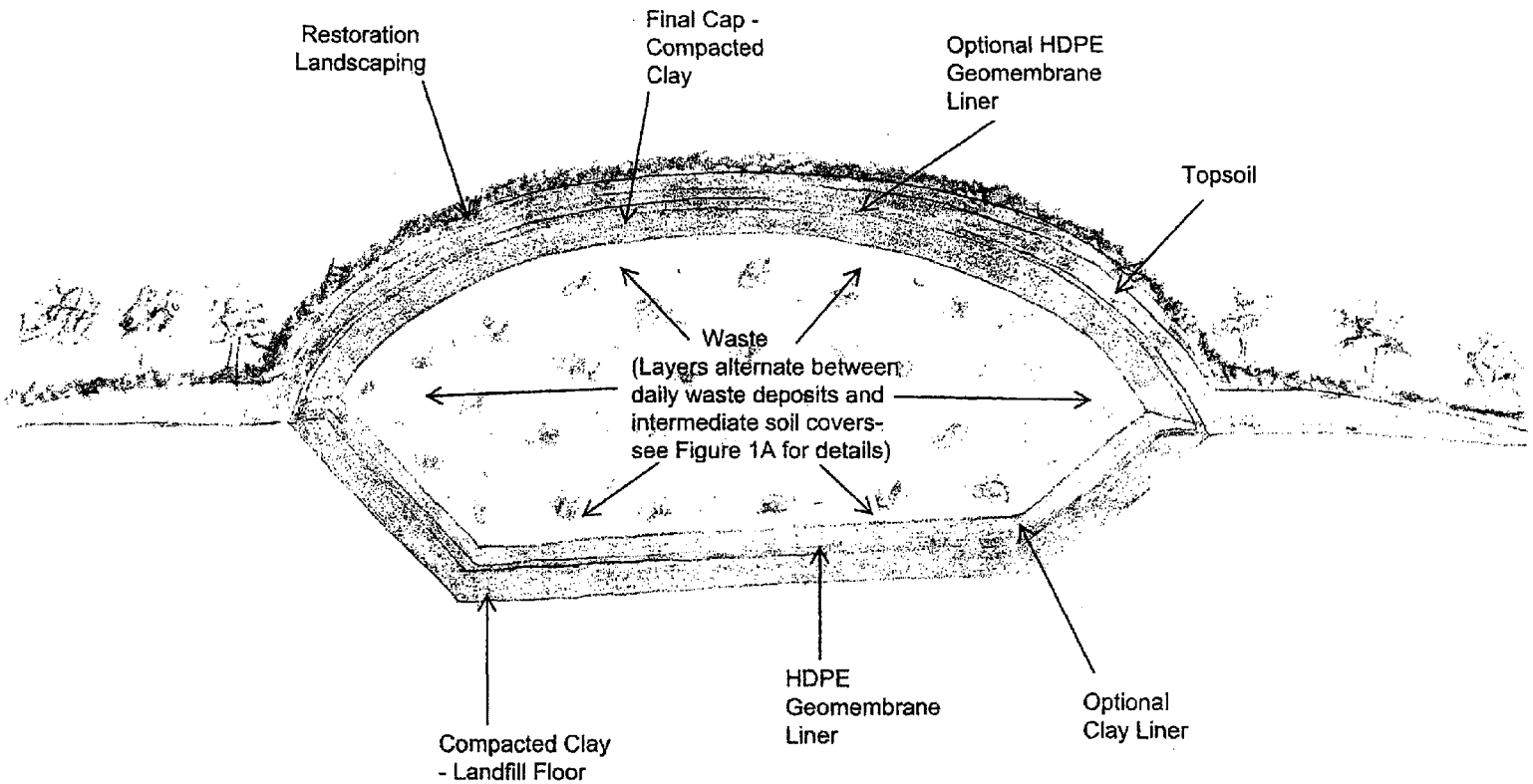
FIG. 1B is a graphic representation of an embodiment of a landfill with a compacted clay floor, HDPE liner, clay, waste, cover soil and a compacted clay cap.
Figure 1C:
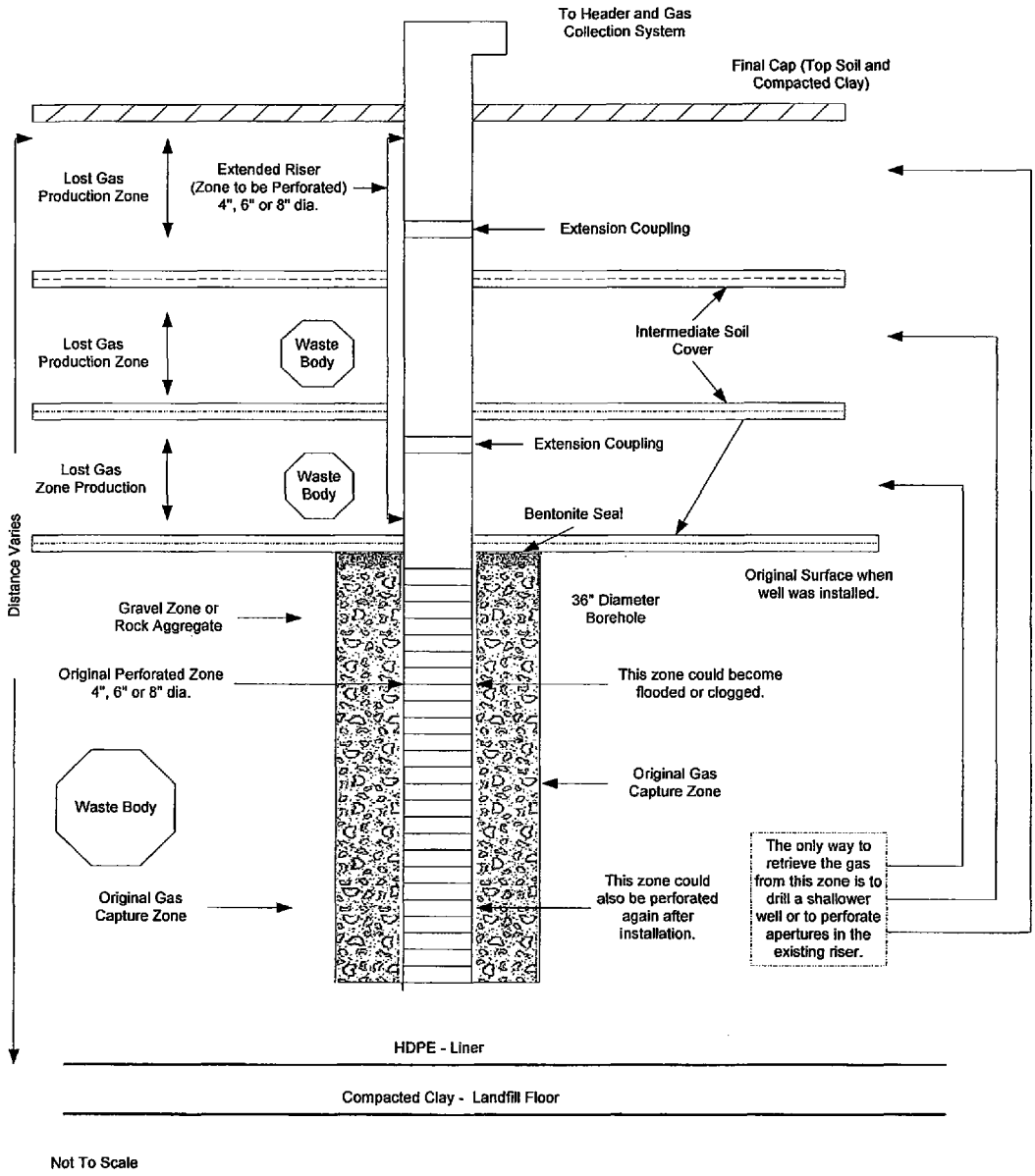
FIG. 1C is a graphic representation of an embodiment depicting a candidate environment for application of the tool.

FIGS. 1A-1C are schematic depictions of landfills and the use of LFG recovery wells. The basic structure of a landfill includes a floor and sidewalls of compacted clay, typically covered with a high density polyethylene (HDPE) polymer liner. Another layer of clay is added to protect the inside of the layer. Layers of waste alternated with clay or soil layers covering the waste will be added to the empty landfill (See FIGS. 1A and 1B). Once a landfill has reached a certain capacity, LFG recovery wells are installed and LFG is extracted from decay and decomposition of waste layers. Generally, a LFG recovery well may be installed by the following method. A bucket auger rig is used to drill a borehole through the waste body. Perforated pipe/screen and riser are lowered into the borehole and set in place. Gravel or rock aggregate is introduced into the annular space between the pipe and the borehole via standard well installation techniques. The level of gravel or rock aggregate is added to a level above the perforated/screen interval. A bentonite seal and backfill soil are installed above the gravel or rock aggregate to ensure well placement to the ground surface (See FIG. 1C). The riser pipe will bring the LFG to the surface header and subsequent gas collection system. Additionally, in areas where LFG recovery wells were installed and waste bodies are added, the riser would need to be extended as shown in FIGS. 1A through 1C. As these LFG recovery wells are extended, riser can be added but not a perforated/screen riser due to the LFG collection system requirements. LFG collection system requirements provide that the screen/perforated section cannot be placed near or above the ground surface because the system runs by a vacuum. The introduction of oxygen from the atmosphere by this vacuum system into the well significantly increases the chance of an underground fire. Currently, the only option after original installation to extract LFG from these subsequently layered waste bodies is to drill an additional well(s). Embodiments of this invention eliminate the need to drill additional LFG recovery wells by creating new apertures in the original perforated pipe/screen zone and/or extended riser (see FIG. 1C).

As used herein "pipe", "riser pipe", "casing", "riser", "vertical pipe" or "extended riser" is defined as any length of pipe and may be used interchangeably for the tubular members extending into the waste body. Due to the corrosive conditions around the LFG well polymeric pipe is preferred. Polymeric pipe materials include many plastic materials, such as but not limited to, polyvinyl chloride (PVC), chlorinated polyvinyl chloride (CPVC), polyethylene (PE), high-density polyethylene (HDPE), cross-linked high-density polyethylene (PEX), polybutylene (PB), and acrylonitrile butadiene styrene (ABS), for example. Due to shifting waste bodies, imperfections in drilling or placement of pipe, and deviation in pipe over time, the pipe may depart from vertical and may even approach horizontal at places within the well.

The internal pipe aperture tool (IPAT) of the present invention creates apertures or openings inside existing landfill gas recovery well riser pipes, either above the original perforated riser or screen section or within the original perforated pipe section, to allow additional production of LFG from the existing or upper zones or in wells where LFG production is reduced or completely inoperable. The terms "aperture", "perforation(s)" and "opening" are used interchangeably and describe the openings created by the tool in the LFG recovery well casing. The apertures in the pipe can be any shape but typically are generally circular in shape. The tool is designed to fulfill the needs of owners and operators at landfills and MSWF to recover LFG from existing wells. It provides increased LFG collection capability to originally perforated zones or riser pipes initially installed in the waste body without perforations and extended with additional riser as waste is added. The number of connected risers can reach lengths of approximately 50 feet or more above the original perforated section of the well. In some embodiments, the tool can operate the length of the entire gas recovery well casing to provide apertures in the existing pipe for gas collection whether or not the pipe is in a vertical position.

Embodiments of the internal pipe aperture tool (referred to herein as tool 10) are shown in FIGS. 2A-2D and 3A-3H and depict various embodiments of the internal pipe aperture tool 10. FIGS. 2A-2D depicts the tool 10 with a generally spherical casing and a single piston for producing a single aperture. FIGS. 3A-3F depicts the tool 10 with a generally cylindrical casing and two pistons for producing multiple apertures. The tool 10 may be plastic, ceramic, metal, carbon steel, cast aluminum, stainless steel, or brass. In a preferred embodiment, the tool 10 is cast aluminum, carbon steel, stainless steel, or brass providing both a durable casing and a weight, between about 5 and about 50 pounds. Preferably the tool 10 weighs between 20 and 40 pounds. The weight of the tool 10 will vary based upon the material, size and shape of the tool. The tool 10 is preferably less than 1 foot long, more preferably about 7 inches long. The size of the tool 10 is dependent on the size of the pipe it is to be used in, but is preferably minimized in length to navigate the inside diameter of the pipe. In some embodiments, a single tool 10 can be used to create apertures (FIGS. 2A-2D and FIGS. 3A-3F). In other embodiments, more than one tool 10 may be connected in series (FIGS. 3G-3H) and used in a pipe to generate multiple apertures at one time.

The diameter of the tool 10 is narrower than the internal diameter of the pipe. Ideally the pipe would be vertical, however, the pipe may have bends or deformations and obstructions that may intrude into the interior of the pipe. Thus the tool body should be less than about 90%, preferably less than about 85%, more preferably less than about 80%, and most preferably less than about 75% of the pipe's internal diameter. In one embodiment, the tool 10 is less than about 5 inches in diameter. In a preferred embodiment, the tool is between about 3 and about 8 inches in diameter, more preferably between about 3 and about 5 inches in diameter for use in standard pipe diameters. The size of the tool 10 will be dependent on the size of the pipe it will be used in and the diameter of the tool is dependent on the internal pipe diameter.

The tool 10 is sized to be placed within the internal diameter of the pipe. After operation, one or more openings or apertures will have been advanced through the pipe as desired with repeated use of the tool 10. The tool 10 is capable of safely operating in conditions that the pipes themselves are rated for in terms of temperature, pressure (internal and external), and corrosivity of the surrounding environment. In some embodiments, the length, width and diameter of the tool 10 is matched to the size and type of pipe it will be used in. In other embodiments, the length, width and diameter of the tool 10 may be expandable to the size and type of pipe it will be used in.

In some embodiments, the tool 10 is operable in various conditions of the well, dry or wet. For example, the tool 10 can be operated under landfill fluid or leachate, in corrosive condensate conditions, under high temperatures, and within explosive ranges of LFG, including methane. The tool 10 is also capable of being used in wells that might have shifted during operation and are not substantially vertical or substantially horizontal. The tool 10 is also able to be maneuvered within deviated pipes. Site conditions or previously used methods for tool advancement down pipes are no longer limiting factors with this tool 10.

Figure 2A:
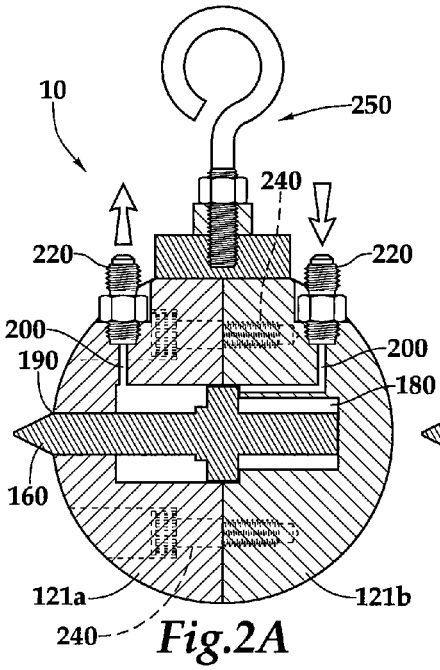
FIG. 2A is a cross-sectional view of an embodiment of the tool with the piston in an unextended (retracted) position.
Figure 2B:
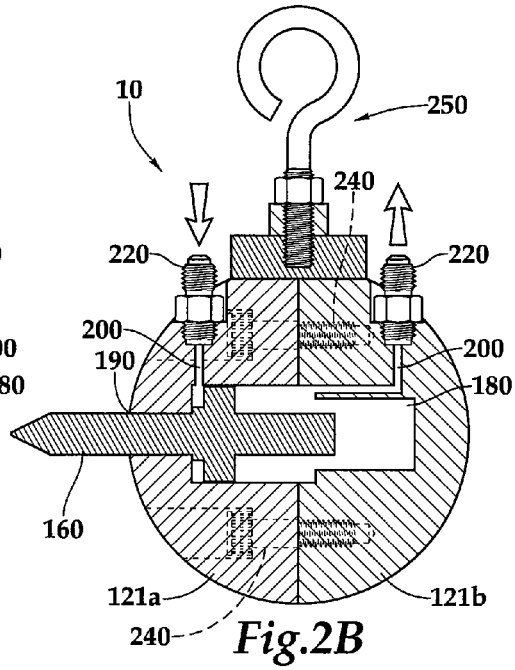
FIG. 2B is a cross-sectional view of the tool of FIG. 2A with the piston in an extended position.
Figure 2C:
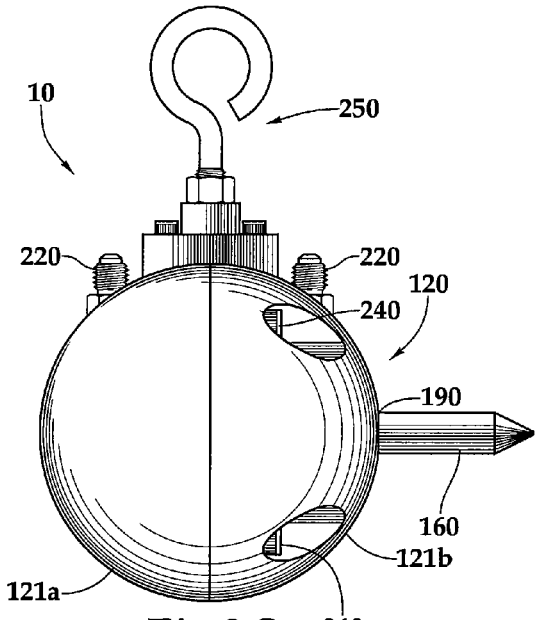
FIG. 2C is a side view of the tool of FIG. 2A with the piston in the extended position.
Figure 2D:
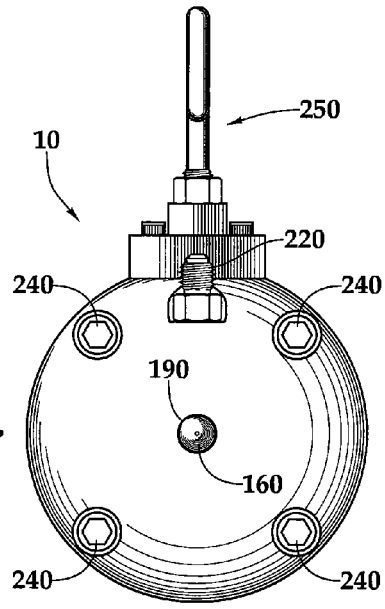
FIG. 2D is a front view of the tool of FIG. 2A.

In a preferred embodiment, such as seen in FIGS. 2A-2D, the tool 10 includes a generally spherical housing 120 having two sections 121*a* and 121*b* and a single piston 160 for providing apertures in the LFG recovery well. FIG. 2A is a cross-sectional view of the tool 10 with the piston in an unextended (retracted) position. FIG. 2B is a cross-sectional view of the tool 10 with the piston in an extended position. FIG. 2C is a side view of the tool 10 with the piston in the extended position. FIG. 2D is a front view of the tool 10. The two sections 121*a* and 121*b* of the housing 120 may be mechanically coupled together while providing a central cavity 180 which houses the piston 160 and allows the piston 160 to move outward from the cavity 180 in an axis approximately perpendicular to the lateral axis of the housing 120. In some embodiments, the external end of the pistons 160 may be blunt, pointed or any shape desired to provide apertures through the casing of the LFG recovery wells. The two sections 121*a* and 121*b* of the housing 120 may be coupled by attachment 240 shown as a screw in FIGS. 2A and 2B. Some examples of attachments 240 include, but are not limited to, bolts, clamps, screws, welds and the like known in the art. The housing 120 further includes one or more bores 200 which provide passage for the motive fluid from outside the tool 10 to the cavity 180 to extend the piston 160 outside the housing 120. In the unextended or retracted position, the piston 160 is inside the cavity 180 with the external end of the piston 160 placed in an opening 190 in the housing 120. In some embodiments, the piston 160 does not protrude from the housing 120 in the retracted position. In the extended position, the piston 160 protrudes outside the housing 120 through the opening 190. The internal end of the piston 160 is enlarged and sized to provide a stop when the enlarged end of the piston 160 contacts the internal wall of the cavity 180 at the opening 190, so the internal end of the piston 160 remains in the housing 120 when fully extended. Seals and O-rings (not shown) assure smooth operation of the piston 160 and prevent leakage of the motive fluid. In a preferred embodiment, the piston 160 extends from the housing 120 from about ½ inch to about 4 inches. In another embodiment, the piston 160 may extend from the housing 120 from about 1 inch to about 2 inches.

In some embodiments, the piston 160 makes an approximately ¼ inch diameter aperture in the pipe wall. The apertures may range from about ¼ inch to about 1 inch in diameter. The size of the aperture will be dependent upon the size of the diameter and thickness of the pipe it will be used in and the size of the piston 160. The piston 160 may create apertures in a variety of pipe materials including PVC pipe, HDPE, or other polymeric pipe materials without damaging the integrity of the pipe.

In some embodiments, the bores 200 include fittings 220 inserted therein. The fittings 220 provide attachment means to the motive fluid at the surface via cables or hoses (not shown). During operation, the fittings 220 are attached to a motive fluid at the surface by hoses or other fluid supply connection so the motive fluid can be delivered to bores 200 and then to the cavity 180. As seen in FIG. 2A, the piston 160 is in an unextended position. When motive fluid enters the bore 200, it travels to the cavity 180 and forces the piston 160 to an extended position (See FIG. 2B). To retract the piston 160, the direction of the motive fluid is reversed and forces the piston back to the retracted position (from FIG. 2B to 2A). In some embodiments, the tool 10 also includes an outer attachment 250 for raising and lowering the tool 10 in the well. In some embodiments, the outer attachment 250 is a hook or other connection attachment, which is connected to the winch 58 (FIG. 5) via cables. The outer attachment 250 may be any component capable of attaching to the tool 10 for lowering or raising the tool 10.

Figure 3A:
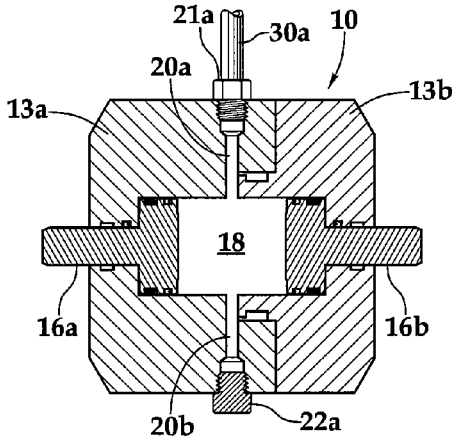
FIG. 3A is a cross section of the view of the tool along the line in FIG. 3C.
Figure 3B:
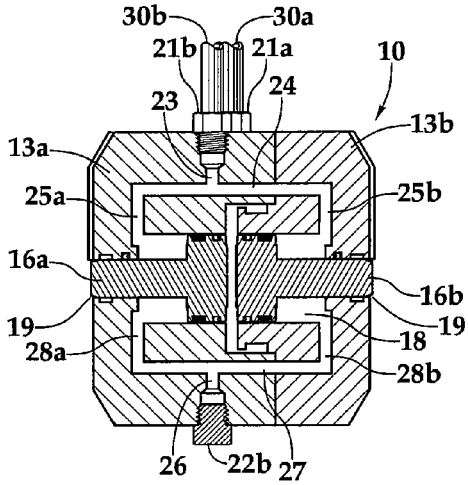
FIG. 3B is a cross section view of the tool along the line in FIGS. 3C and 3D.
Figure 3C:
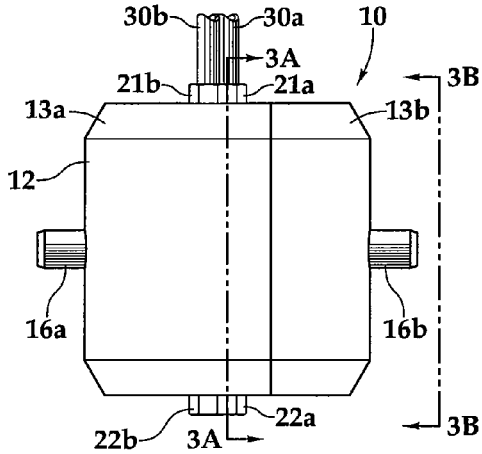
FIG. 3C is a front view of an alternate embodiment of the tool.
Figure 3D:
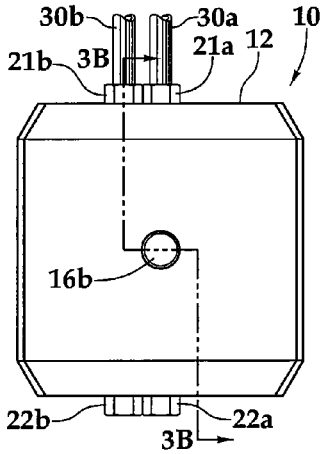
FIG. 3D is a side view of the tool of FIG. 3A.
Figure 3E:
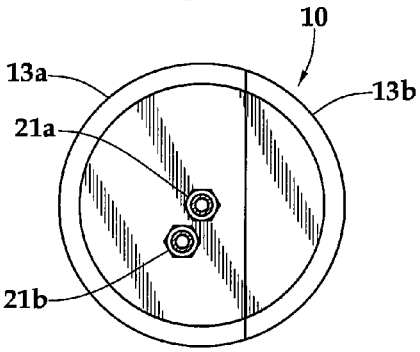
FIG. 3E is a top view of the tool of FIG. 3A.
Figure 3F:
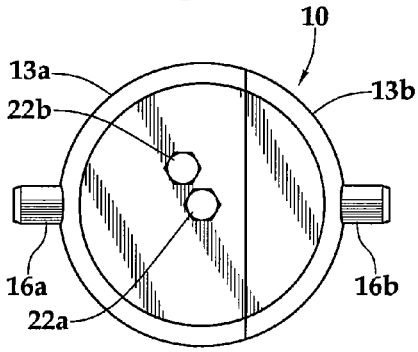
FIG. 3F is a bottom view of the tool of FIG. 3A with the pistons in an extended position.

Shown in FIGS. 3A-3F is another embodiment of a tool 10 having a generally cylindrical housing 12 having two sections 13*a* and 13*b* and two pistons 16*a* and 16*b* approximately 180 degrees apart for providing apertures in the LFG recovery well. FIG. 3A is a cross section of the view along the line 3A in FIG. 3C showing both pistons 16 extended. FIG. 3B is a cross section view along the line 3B in FIG. 3D showing both pistons 16 retracted. FIG. 3C is a front view of the tool 10 with the pistons extended. FIG. 3D is a side view of the tool 10 showing one piston 16*b*. FIG. 3E is a top view of the tool with the pistons 16 retracted. FIG. 3F is a bottom view of the tool 10 with the pistons 16 extended. The two sections 13*a* and 13*b* of the housing 12 may be mechanically coupled together while providing a central cavity 18 which houses the pistons 16*a* and 16*b* and allows the pistons 16*a* and 16*b* to move outward from the cavity 18 in an axis perpendicular to the lateral axis of the housing 12. The two pistons 16*a* and 16*b* are positioned in the cavity 18 with their internal ends adjacent to each other with a space between the internal ends. In some embodiments, the space may include a washer (not shown) to provide a cushion for the pistons 16*a* and 16*b* when retraction occurs. The two sections 13*a* and 13*b* of the housing 12 may be coupled by mechanical attachments. Some examples of attachments include, but are not limited to, bolts, clamps, screws, welds and the like known in the art.

In the unextended (retracted) position, the pistons 16 are inside the cavity 18 with the external end of the pistons 16 placed in an opening 19 in the housing 12 sized to receive the external end of the piston 16 (FIG. 3B). In the extended position, the pistons 16 protrude outside the housing 12 through the openings 19 (FIG. 3A). The pistons 16 are held within the cavity 18 by pressure being supplied by a motive fluid. In some embodiments, the external end of the pistons may be blunt, pointed or any shape desired to provide apertures through the casing of the LFG recovery wells. The internal end of the piston 16 is enlarged and sized to provide a stop when the enlarged end of the piston 16 contacts the internal wall of the cavity 18 at the opening 19, so the internal end of the piston 16 remains in the housing 12 when fully extended. In a preferred embodiment, the piston 16 extends from the housing 12 from about ½ inch to about 4 inches. In another embodiment, the piston 16 may extend from the housing 12 from about 1 to about 2 inches. In some embodiments, the piston 16 makes an approximately ¼ inch diameter aperture in the pipe wall. The apertures may range from about ¼ inch to about 1 inch in diameter. The size of the aperture will be dependent upon the size and thickness of the pipe and the diameter of the piston 16 used to create the aperture. The piston 16 may create apertures in a variety of pipe materials including PVC, HDPE, or other polymeric pipe materials without damaging the integrity of the pipe.

In some embodiments, the housing 12 includes a substantially vertical central bore 20 which is operatively connected from the top section of the housing 12 to the bottom section of the housing 12 by the cavity 18. In a preferred embodiment, there is a top central bore 20*a* and a bottom central bore 20*b*. The central bore 20 provides passage for the motive fluid from outside the housing 12 to the cavity 18 (or vice versa). In a preferred embodiment, a fitting 21*a* is placed within the top central bore 20*a* and a plug 22*a* is placed in the bottom central bore 20*b*. The fitting 21*a* provides passage of the motive fluid to the top central bore 20*a* and at the opening of the bottom central bore 20*b*, the plug 22*a* will prevent passage of the motive fluid out of the bottom central bore 20*b*.

The housing 12 further includes a substantially vertical bore 23 extending from the top section of the housing 12. In a preferred embodiment, the vertical bore 23 is operatively connected to a horizontal passage 24 which extends inside the housing 12 from either side of the vertical bore 23. Either end of the horizontal passage 24 communicates with and is operatively connected to a first passage 25*a* and a second passage 25*b* (sometimes referred to as passages 25) that extend inside the housing vertically into and are operatively connected to the cavity 18. In a preferred embodiment, the first passage 25*a* and the second passage 25*b* are located at opposite ends of the cavity 18. The vertical bore 23, horizontal passage 24 and first and second passages 25*a* and 25*b* provide motive fluid inside the cavity 18 to retract the pistons 16*a* and 16*b*.

In some embodiments, the housing 12 further includes a second vertical bore 26 in the bottom section of the housing 12. In a preferred embodiment, the second vertical bore 26 is operatively connected to a horizontal passage 27 which is operatively connected at both ends to a first passage 28*a* and a second passage 28*b* (sometimes referred to as passages 28) which are operatively connected to the cavity 18 in the same manner as described for the vertical bore 23, horizontal passage 24 and first and second passages 25*a* and 24*b* described above. In a preferred embodiment, a fitting 21*b* is placed within the vertical bore 23 and a plug 22*b* is placed in the vertical bore 26. The fitting 21*b* provides passage of the motive fluid to the vertical bore 23 and the plug 22*b* prevents passage of the motive fluid out of the vertical bore 26 in the bottom section of the housing 12. In an alternate embodiment, the bottom section of the housing 12 does not include the vertical bore 26, the horizontal passage 27, the first passage 28*a* or the second passage 28*b*.

Prior to operation, fittings 21*a* and 21*b* are connected to a motive fluid at the surface by hoses 30*a* and 30*b*, respectively. Motive fluid is provided to the tool 10 via fittings 21*a* and 21*b* and bores 20*a* and 23 to maintain the pistons 16 in position via equilibrium. To extend the pistons 16*a* and 16*b*, the motive fluid is provided at pressures ranging from about 1000 to about 3500 psi from outside the housing 12 through the hose 30 through fitting 21*a* through bore 20 to internal cavity 18, thereby extending the pistons 16*a* and 16*b*. As the motive fluid enters cavity 18 via bore 20*a*, the motive fluid providing equilibrium to the tool 10 in the cavity 18 is forced out via passages 25*a* and 25*b*, bore 23 and fitting 21*b*.

To retract the pistons 16, the motive fluid is provided at pressures ranging from about 1000 to about 3500 psi from outside the housing 12 through hose 30 through fitting 21*b* through bore 23, horizontal passage 24 and vertical passages 25*a* and 25*b* to internal cavity 18, thereby retracting the pistons 16*a* and 16*b*. The horizontal passage 24 provides motive fluid to both ends of the cavity 18 at substantially the same time. As the motive fluid enters cavity 18 via passages 25, motive fluid also exits the tool via bore 23 and fitting 21*b*.

The fittings 21*a* and 21*b* may be coupled, or encased in an end-cap using a variety of connectors known to one of ordinary skill in the art. Connectors include, but are not limited to, screw-type connectors, hydraulic connectors, pressure fittings, and the like. Although not described, it is understood by one skilled in the art that seals, O-rings and the like are used to assure smooth operation of the pistons 16 and prevent leakage of the motive fluid. Hoses 30*a* and 30*b* are any known to those skilled in the art which are capable of providing motive fluid to the tool at the stated pressures.

Figure 3G:
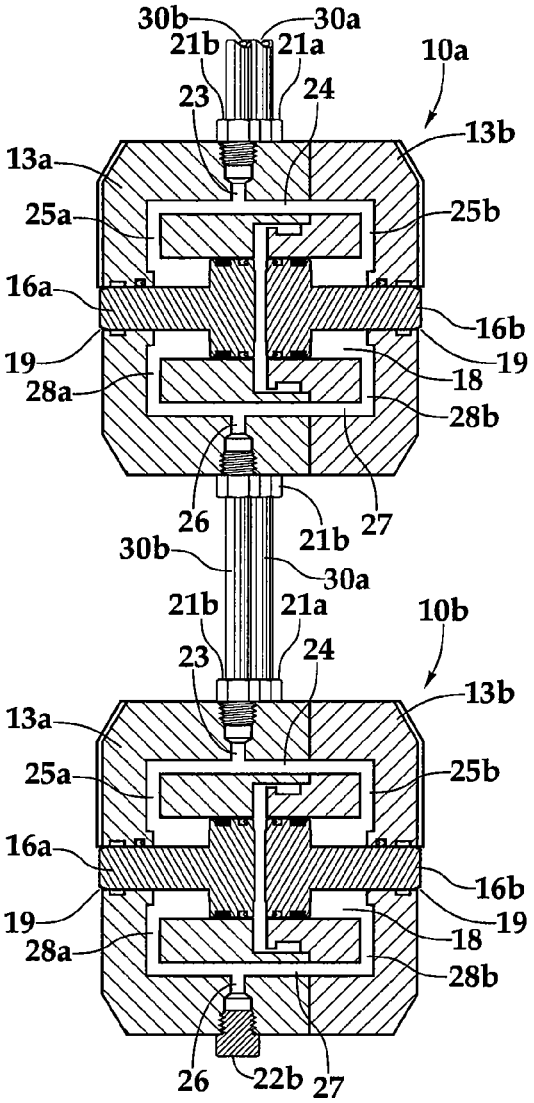
FIG. 3G is a cross section of an alternate embodiment having a plurality of tools with the pistons in the retracted position.
Figure 3H:
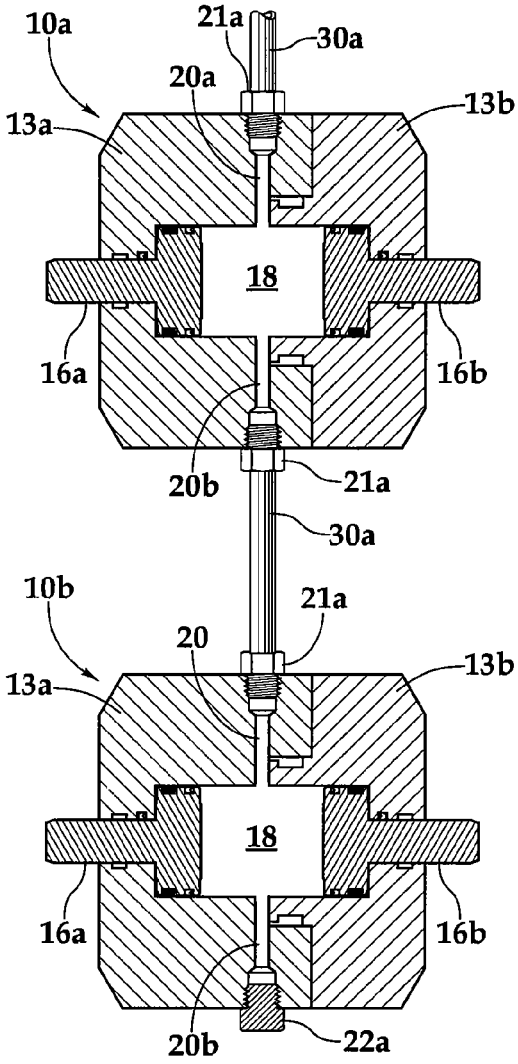
FIG. 3H is a cross section of an alternate embodiment having a plurality of tools with the pistons in the extended position.

In an alternate embodiment, a plurality of tools 10 may be operated as seen in FIGS. 3G-3H. A first tool 10*a* and a second tool 10*b* may be connected in series (See FIG. 3H). The tools 10*a* and 10*b* are as described above. A first fitting 21*a* is placed in the top central bore 20*a* and a second fitting 21*a*' is placed in the bottom central bore 20*b* of the first tool 10*a*. The second fitting 21*a*' is connected to the fitting 21*a*" of the second tool 10*b* via a hose 30. A plug 22*a* is placed in the bottom central bore 20*b* of the second tool 10*b*. A first fitting 21*b* (See FIG. 3G) is placed in the vertical bore 23 of the first tool 10*a* and a second fitting 21*b*' is placed in the vertical bore 26 in the bottom central bore of the first tool 10*a*. The second fitting 21*b*' is connected to the fitting 21*b*" of the second tool 10*b* via a hose 30. A plug 22*b* is placed in the vertical bore 26 in the bottom central bore of the second tool 10*b*.

Prior to operation, fittings 21 are connected to a motive fluid at the surface by hoses 30. Motive fluid is provided to the first tool 10*a* via fittings 21 and bores 20*a* and 23 and to the second tool 10*b* via fittings 21 to maintain the pistons 16 in position via equilibrium. To extend the pistons 16*a* and 16*b* in the first tool 10*a*, the motive fluid is provided at pressures ranging from about 1000 to about 3500 psi from outside the housing 12 through hose 30 through fitting 21*a* through bore 20 to internal cavity 18, thereby extending the pistons 16*a* and 16*b*. To extend the pistons 16*a* and 16*b* in the second tool 10*b*, the motive fluid is provided through bore 20*b* to fitting 21*a* of the first tool 10*a* through hose 30 to the fitting 21*a* of the second tool 10*b* through bore 20 to internal cavity 18, thereby extending the pistons 16*a* and 16*b* of the second tool 10*b*. The plug 22*a* prevents the motive fluid from exiting the second tool 10*b*.

To retract the pistons 16 of the first tool 10*a* (see FIG. 3G), the motive fluid is provided at pressures ranging from about 1000 to about 3500 psi from outside the housing 12 through hose 30 through fitting 21*b* through bore 23, horizontal passage 24 and vertical passages 25 to internal cavity 18, thereby retracting the pistons 16*a* and 16*b* of the first tool 10*a*. To retract the pistons 16 of the second tool 10*b*, the motive fluid is provided through vertical passages 28, horizontal passage 27, and vertical bore 26 out fitting 21*b* of tool 10*a* through hose 30 to fitting 21*b* to of the second tool 10*b* through bore 23, horizontal passage 24 and vertical passages 25 to internal cavity 18, thereby retracting the pistons 16*a* and 16*b* of the second tool 10*b*. The plug 22*b* prevents the motive fluid from exiting the second tool 10*b*. The horizontal passages 25 provide motive fluid to both ends of the cavity 18 at substantially the same time.

In other embodiments, the housing 12 may be an elongate oval, cylindrical, spherical, or any geometrical shape capable of being placed within the LFG recovery well. The tool 10 is sized to be placed within the casing of the LFG recovery well. The LFG recovery well casing may be a polymeric pipe, such as but not limited to, polyvinyl chloride (PVC), chlorinated polyvinyl chloride (CPVC), polyethylene (PE), high-density polyethylene (HDPE), cross-linked high-density polyethylene (PEX), polybutylene (PB), and acrylonitrile butadiene styrene (ABS). The tool 10 can be sized, retrofitted and adapted to the different thicknesses and diameters found in the polymeric pipes. The pipes are commonly rated for different psi ratings and will have varying wall thicknesses. The outer diameter of the pipe may vary from about 4 inches or larger, typically 6 to 8 inch diameter LFG recovery wells are most common.

In some embodiments, the pistons 16 or piston 160 will create apertures in the LFG recovery well, where the riser is adjacent to waste, soil or rock aggregate. The pistons 16 or piston 160 preferably provides apertures ranging from about ¼ inch to about 1 inch in diameter, but different sized apertures may be used depending on the size of the pipe and the wall thickness. The pistons 16 or piston 160 may have a blunt tip, a pointed tip, a beveled tip or a chamfered tip. In some embodiments, the apertures are circular but may be any geometric shape created by the tip of the piston. In some embodiments, the pistons 16 may be positioned on opposing sides of the pipe, either 180° apart for two pistons, 120° for three pistons, or 90° for four pistons. This may be realized by joining more than one tool 10*a* in series as depicted in FIGS. 3G and 3H. In other embodiments, the pistons 16 or piston 160 may be spaced in other configurations depending on the size of the pipe and wall thickness. The pistons 16 or piston 160 may have a blunt tip, a pointed tip, a beveled tip or a chamfered tip.

All parts described herein are commercially available, but may be manufactured to meet the specifications described herein if custom sizes or materials are desirable. Additionally, the tool may be scaled for larger or smaller pipes thus the part selected may be replaced with an appropriately sized part.

Figure 5:
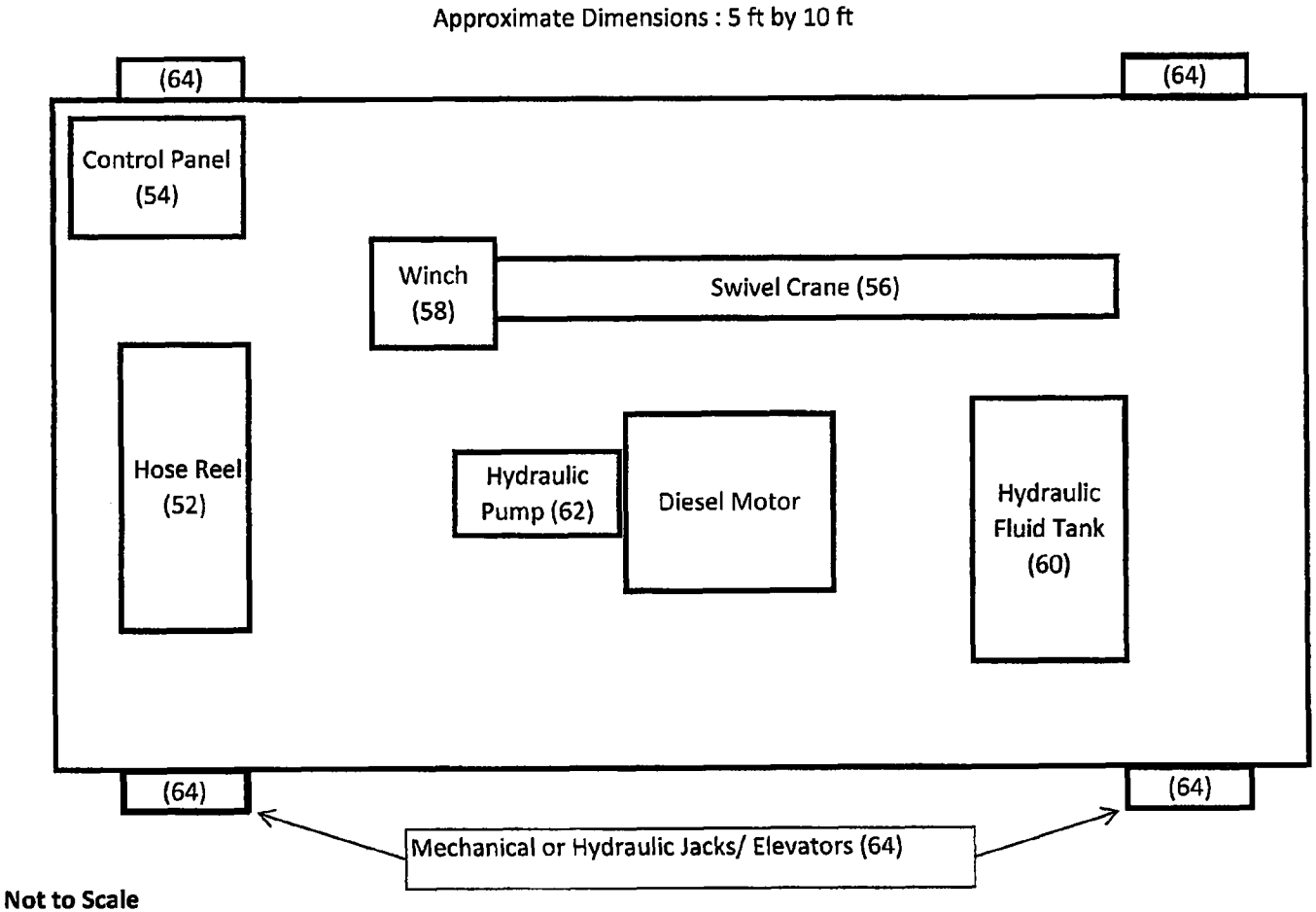
FIG. 5 is a schematic representation of a first embodiment of a carrier unit for the tool.

In some embodiments, the tool 10 is preferably mounted on a carrier 50 which will transport the tool 10 to the desired location and position the tool 10 over the opening of the LFG recovery well. An exemplary embodiment of a layout of the carrier 50 is shown in FIG. 5. The carrier 50 may be a truck and trailer, a tractor which can pull a trailer, a small track mounted unit, ATV mounted unit, and either a radio controlled unit or a self propelled unit. For a hydraulically powered tool, the carrier 50 may include a hose reel 52, a control panel 54, a swivel crane 56, a winch 58, a hydraulic fluid tank 60, a hydraulic pump 62, and elevators 64. The hose reel 52 provides the hydraulic hoses which when attached to the tool 10 will provide the motive fluid. The control panel 54 controls the hydraulic pump 62 to assure that the motive fluid is provided for at the proper pressure. The control panel 54 will also be used to reverse the direction of the motive fluid to retract the piston(s) 16 or 160. The swivel crane 56 and winch 58 provide wire cable for positioning the tool 10 within the pipe. The hydraulic fluid tank 60 and hydraulic pump 62 provide the motive fluid to the tool 10 via the hydraulic hoses 30.

In some embodiments, the elevators 64 may be manual, mechanical or hydraulic jacks for assuring the carrier 50 will be leveled for safe operation. In some embodiments, the tool 10 can be operated via pressure supplied by a motive fluid including diesel, hydraulic fluid, compressed air, or other non-sparking motive fluid supply mounted on the carrier 50. In some embodiments, the motive fluid is supplied by a hydraulic pump 62. The hydraulic pump 62 may provide the motive fluid to the tool 10 by approximately 8 horsepower to approximately 100 horsepower, preferably between about 10 horsepower and about 15 horsepower. A larger or smaller hydraulic pump 62 may be used dependent upon the size of the pipe and the size of the tool. The hydraulic pump 62 transmits motive fluid through hydraulic hoses 30 to the tool 10 through connectors and fittings known to one skilled in the art and described above.

In a preferred embodiment, the carrier 50 is a track mounted unit which can traverse in, on or over ground which is: even, uneven, level, unlevel, wet, dry, grass, dirt, municipal waste, clay, soil, sand or any combination thereof. Furthermore, the carrier 50 can also be transported up and down inclines and slopes. In some embodiments, the carrier 50 can be used on slopes ranging from about 0 degrees to about 50 degrees off the horizontal axis. In some embodiments, the carrier 50 will transport the tool 10 to and from difficult locations on side slopes and low lying areas, or areas which have had differential settling. The carrier 50 may also transport the tool 10 over ruts and eroded features of the landfill. The carrier 50 preferably is capable of maneuvering over wet ground without damaging the ground or landfill liner. In some embodiments, the use of a small track mounted carrier with the tool 10 will reduce the damage to the clay and landfill cap in areas of final cover. In some embodiments, the ground bearing pressure of the carrier 50, depending on track widths, may range from as little as about 2.5 psi to about 5.2 psi. The carrier 50 is capable of traveling on any type of terrain where LFG wells are located.

Figure 4A:
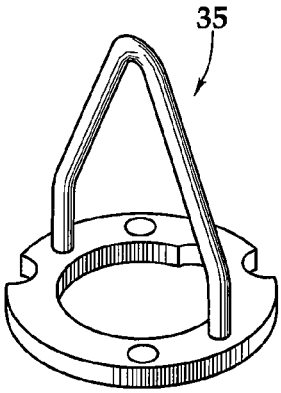
FIG. 4A is a perspective view of an embodiment of an attachment mechanism.
Figure 4B:
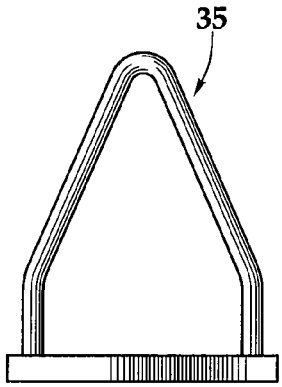
FIG. 4B is a front view of an embodiment of the attachment mechanism of FIG. 4A.

Operation of the tool 10 may include positioning the tool 10, lowering the tool 10, activating the tool 10, and retrieving the tool 10. In some embodiments, the tool 10 is positioned within the LFG recovery well using a hydraulic or electric crane apparatus which is located on the carrier 50. The hose reel 52 will have hydraulic hose 30 attached to the fittings 21 or 220 of the tool 10. The tool 10 will be coupled to the swivel crane 56 via the attachment member 35 (See FIGS. 4A and 4B). The carrier 50 will then be positioned near the LFG recovery well either by radio control or self-propelled methods. The operator will use the control panel 54 to operate the swivel crane 56, including cables, to position the tool 10 over the LFG recovery well and lower the tool 10 the appropriate distance. The tool 10 is preferably operated from about 10 to about 15 feet below the ground surface and may achieve depths of from about 150 to about 160 feet or more below the well head. The tool 10 is preferably sized to be positioned within the LFG recovery well and be able to pass obstructions, such as but not limited to, couplers, bolts, lag bolts or any other down hole obstruction. The tool 10 also preferably is able to be used in vertical, horizontal, slanted wells or wells with deviations and/or offsets. After positioning the tool 10, the hydraulic pump 62 is activated via the control panel 54 and the pistons 16 or piston 160 is extended to create the apertures in the well casing. After the apertures have been made in the LFG recovery well, the operator will use the control panel 54 to reverse the direction of the hydraulic fluid and retract the pistons 16 or piston 160. The tool 10 may then be repositioned using the control panel 54 and the swivel crane 56. Alternatively, the tool 10 may be lifted out of the LFG recovery well.

In some embodiments, the tool 10 may be used on LFG recovery well casings already having perforations there through that are obstructed by water, mud, or debris. The tool 10 may be lowered into a well and encounter water, leachate or corrosive liquid. The tool 10 can safely operate in a section of the well above, within or below this liquid. The tool 10 can be positioned to achieve perforations adjacent to, at or just above the existing perforated section. The tool 10 can be raised to open an avenue of gas previously unattainable by the original perforations. The tool 10 will provide new apertures at a depth at least 10 to 15 foot below the surface of the landfill to ensure that oxygen does not intrude into the well vacuum system. If required, the tool 10 can be utilized in the existing perforation section of a LFG recovery well to rehabilitate non-functional wells, or low producing existing production zones. The apertures will provide additional open area for LFG to enter in these existing perforation zones. The tool 10 and process can be repeated multiple times if additional riser pipe is added to the well location. The process can be repeated months or years after the original installation of the well. The process allows for capturing LFG in all stages of gas generation to minimize the release into the atmosphere, whereby reducing emissions of greenhouse gases.

In some embodiments, more than one tool 10 may be lowered into the well. In a preferred embodiment, the plurality of tools 10 may be mechanically coupled together by welding or attachment means such as, but not limited to, clamps, screws, and the like. The plurality of tools 10 may be coupled via hoses, cables, or springs. The tool 10 can be used in explosive or non-explosive environments. In a preferred embodiment, the tool 10 can be used in the entire explosive range of methane: above, below or within. After the apertures are made, the motive fluid direction is changed and the pistons 16 or 160 are retracted. The tool 10 can be repositioned and the process repeated until a desired number of apertures is achieved. In a preferred embodiment, a wire cable is used to lower the tool 10. In some embodiments, the tool 10 can be designed to have holes drilled longitudinally, along the axis or length of the tool. Therefore, if the tool 10 were to become lodged in the well, the flow of LFG would not be restricted from elevations and zones below the tool 10.

The tool may be operated in an explosive environment; therefore a non-sparking motive fluid source is preferred. In one embodiment air or hydraulic fluid is used to operate the tool 10. In a preferred embodiment, a pump connected to a hydraulic feed and return line are used to pressurize the tool 10 and recirculate hydraulic fluid. Additionally, a steel cable, rope, or pipe may be attached to the tool for positioning the tool 10 within the pipe. The tool 10 can be operated without altering the conditions in the annular space of the LFG recovery well. The tool 10 can operate safely without inserting any type of inert gases, air, or water. In some embodiments, the tool can be operated using biodegradable hydraulic fluid, or a similar material, to prevent any adverse conditions in the event of a seal or O-ring leakage from the tool 10.

A preferred operating procedure for the tool 10 begins with determining if weather conditions permit field operation of the tool 10. A review of the LFG well location plan is performed to determine a preferable way to mobilize the carrier 50 and the tool 10 to each required location. The operator will be provided with various well measurements and properties. The operator will also perform measurements at the LFG recovery well to verify the measurements and properties including the length of the LFG recovery well casing, the depth to the existing top of screen and/or depth to and location of water or obstructions below ground. Some useful definitions regarding typical LFG recovery wells include:

Total Well Length—the amount of well casing and screen section below the ground combined with the amount of pipe sticking up above the ground.

Screen Length—the amount of apertured well casing installed during the well's initial installation.

Riser Length—the amount of well casing that has not been perforated.

Above Grade Length—the amount of well casing that is measured above the ground surface.

Below Grade Length—the amount of well casing that is measured below the ground surface.

Perforation Length—the amount of well casing to be perforated by use of the tool 10.

Starting Depth—the depth to which the tool 10 will be lowered and perforation of the well will begin.

Stopping Depth—the depth to which the tool 10 will be raised and perforation of the well will stop.

The operator may verify the total well length by either the tape measure method or the video camera method, or other methods known to those skilled in the art. To determine the starting depth, the operator subtracts the screen length from the total well length. Starting depth may also be determined by measuring the depth to water or obstruction in the well, perforation will begin at this depth or a higher specified depth. To determine the stopping depth, the perforation length is subtracted from the starting depth. Care should be taken not to perforate above the zone specified to be perforated and to ensure all perforations are at least 10 to 15 feet below ground level due to LFG collection system requirements to prevent a downhole fire in the LFG recovery well.

After calculations have been completed, the carrier 50 is positioned near enough to the well so that the tool 10 can be positioned directly over the well. A hydrogen sulfide ($H_2S$) meter is turned on to monitor the area. Initial LFG recovery well readings are taken, including, but not limited to, oxygen ($O_2$%), temperature (° F.), pressure (psi), methane ($CH_4$%), carbon dioxide ($CO_2$%) and gas flow rates ($\Delta P$). The readings may be obtained using a GEM-2000 gas meter or similar device. Prior to tool 10 operation, the vacuum system is turned off and the well head is removed from the riser pipe. The tool 10 is positioned directly over the well. The tool 10 is lowered into the LFG recovery well to the calculated Starting Depth. The hydraulic hose 30 for motive fluid and cable are released to lower the tool 10. Moving the perforation lever on the control panel 54 to activate will stimulate the hydraulic fluid to extend the piston(s) 16 or 160. Moving the perforation lever on the control panel 54 to deactivate will stimulate the hydraulic fluid to retract the piston(s) 16 or 160. After the piston 160 or pistons 16 have been retracted, the tool 10 may be repositioned to provide apertures along the length of the riser until the prescribed Stopping Depth is reached. The tool 10 is then raised out of the well and the hoses and cable are disconnected. The wellhead is reattached and the vacuum is returned to its original level or other landfill operator specified level. Post-Perforation readings from the well should be taken, such as, but not limited to, oxygen ($O_2$%), temperature (° F.), pressure (psi), methane ($CH_4$%), carbon dioxide ($CO_2$%), and gas flow rates ($\Delta P$) obtained using a GEM-2000 gas meter or similar device.

LFG recovery wells may be perforated with the tool 10, when LFG production from a given LFG recovery well is reduced due to clogging, flooding, pipe damage, or other factors that may make the well underperform or otherwise be inoperable. LFG recovery wells may also be perforated to meet compliance requirements. A pipe may also have apertures provided as upper waste bodies begin to produce LFG, or pipes may be perforated in an effort to reduce total LFG emissions. First, a visual inspection of the vertical pipe ensures the riser is continuous and not damaged. A video camera can be run down the pipe to identify obstructions, mark depths and identify any bends in the pipe. Depths of target waste body and desired areas for apertures are then determined and the amount of apertures required for the riser length is calculated. The tool 10 is lowered down the vertical pipe (or pushed if a solid pipe, bar, or wire is attached) to the desired depth. Operation is initiated by pressurizing the tool 10 and expanding the piston 16 or 160 to the walls of the pipe. Once the pipe is punctured to create apertures, the pistons 16 or 160 is retracted. The tool 10 may be rotated to add additional perforations at the same elevation or raised to add apertures at a different elevation. The tool 10 is removed when the desired amount of apertures are produced. If required a video camera may be used to verify aperture depth and size. The LFG recovery wells are then monitored and compared to prior LFG production rates.

Flow and composition of the LFG can be measured and monitored using a gas meter or gas meters capable of being calibrated and obtaining readings for $CH_4$, $CO_2$, $O_2$, % LEL $CH_4$, temperature, static pressure, differential pressure, gas flow rates and BTU content. Readings may be taken before using the tool 10 (pre-aperture) and after using the tool 10 (post-aperture). Readings can be evaluated by gas composition percent (%) by volume $CH_4$, $CO_2$, $O_2$, % LEL $CH_4$, temperature, static pressure, differential pressure, gas flow rates and BTU content. The following data was collected from seven wells, pre- and post-aperture of the tool 10.

| | Pre-Aperture | Post Aperture |
|---|---|---|
| Well A | | |
| Methane (wt %) | 43.9 | 46.2 |
| Carbon dioxide (wt %) | 33.7 | 38.3 |
| Oxygen (wt %) | 4.5 | 2.1 |
| Balance Gas (wt %) | 17.8 | 12.8 |
| Flow (SCFM) | 0 | 11 |
| Well B | | |
| Methane (wt %) | 40.0 | 47.3 |
| Carbon dioxide (wt %) | 34.7 | 39.3 |
| Oxygen (wt %) | 4.2 | 2.5 |
| Balance Gas (wt %) | 21.1 | 11.4 |
| Flow (SCFM) | 0 | 11 |
| Well D | | |
| Methane (wt %) | 40.8 | 51.7 |
| Carbon dioxide (wt %) | 25.1 | 39.2 |
| Oxygen (wt %) | 5.1 | 0.4 |
| Balance Gas (wt %) | 29.0 | 8.6 |
| Flow (SCFM) | 0 | 43 |
| Well E | | |
| Methane (wt %) | 49.0 | 49.6 |
| Carbon dioxide (wt %) | 42.5 | 39.5 |
| Oxygen (wt %) | 0.6 | 1.0 |
| Balance Gas (wt %) | 7.9 | 9.7 |
| Flow (SCFM) | 5 | 44 |
| Well F | | |
| Methane (wt %) | 46.5 | 50.1 |
| Carbon dioxide (wt %) | 38.0 | 40.1 |
| Oxygen (wt %) | 1.9 | 0.8 |
| Balance Gas (wt %) | 13.7 | 8.9 |
| Flow (SCFM) | 8 | 34 |
| Well G | | |
| Methane (wt %) | 25.5 | 52.0 |
| Carbon dioxide (wt %) | 27.6 | 26.0 |
| Oxygen (wt %) | 6.8 | 3.1 |
| Balance Gas (wt %) | 40.0 | 20.6 |
| Flow (SCFM) | 0 | 6 |

From the results above, an increase in the flow of LFG occurred at all wells. Furthermore, the volume of LFG was increased. For example, oxygen levels above 5% put the LFG recovery well out of compliance with the New Source Performance Standards (NSPS). The above data shows that the apertures in the casing treated with the tool 10 decreased the amount of oxygen in the captured LFG. The LFG recovery wells should always meet the standards set by the Environmental Protection Agency (EPA), such as "Standards of Performance, Emission Guidelines, and Federal Plan for Municipal Solid Waste Landfills and National Emission Standards for Hazardous Air Pollutants; Municipal Solid Waste Landfills". These include the New Source Performance Standards (NSPS) 40 *CFR Part* 60, *Subparts Cc and WWW*. The tool 10, as shown above, is successful in bringing out-of-compliance LFG recovery wells back into an acceptable range as set forth by the EPA.

An increase in capture of LFG from a MSWF is a direct decrease in fugitive emissions of LFG into the atmosphere. Therefore capturing all potential LFG by utilizing the tool and the associated method assists in the protection of air quality and the environment. If the methodology was not implored and the LFG was allowed to escape into the atmosphere, it would contribute to climate change by increasing the amount of greenhouse gas (GHG) emissions.

The amount of LFG produced may increase from about 5% to over 150% above previous production levels. In another embodiment LFG production is increased from about 10% to about 100% above previous production levels. When increasing the LFG collection capacity in new waste bodies within each LFG recovery location, the amount of LFG produced may double or triple depending on the length of riser in which apertures were created.

In conclusion, the present invention and the embodiments disclosed herein are well adapted to carry out the objectives and obtain the ends set forth. Certain changes can be made in the subject matter without departing from the spirit and the scope of this invention. It is realized that changes are possible within the scope of this invention, and it is further intended that each element or step recited is to be understood as referring to all equivalent elements or steps. The description is intended to cover the invention as broadly as legally possible in whatever forms it may be utilized.

What is claimed is:

1. An aperture tool for producing landfill gas from the pipe of a landfill gas recovery well comprising a housing with a cavity inside the housing;

at least one piston positioned within the cavity having an outer end of the piston capable of extending through an opening in the housing sized to receive the outer end of the piston;

a first bore in the housing for providing a channel for flow of motive fluid into and out of the cavity in the housing so that when motive fluid is introduced into the cavity behind the outer end of the piston via the first bore, the fluid provides pressure to the piston and pushes the outer end of the piston through the opening in the housing with sufficient force to create an aperture through the pipe of the landfill recovery well; and a second bore in the housing for providing a channel for flow of motive fluid into and out of the cavity so that when motive fluid is introduced into the cavity via the second bore it provides pressure to the piston and retracts the outer end of the piston through the opening in the housing, wherein the housing is generally spherical in shape.

2. The aperture tool of claim 1, wherein the piston comprises an enlarged end spaced from the outer end of the piston and contacts an internal wall of the cavity at the opening of the housing providing a stop to prevent the piston from sliding out of the housing.

3. The aperture tool of claim 1, wherein the aperture created in the pipe of the landfill gas recovery well ranges from about ¼ inch to about 1 inch in diameter.

4. The aperture tool of claim 1, further comprising a carrier to transport the tool to the landfill gas recovery well.

5. The aperture tool of claim 1, wherein the motive fluid supplies pressure ranging from about 1000 to about 3500 psi.

6. The aperture tool of claim 1, wherein the aperture tool is safely operable above and within landfill fluids selected from water, leachate, corrosive condensate, and explosive ranges of the landfill gases.

7. The aperture tool of claim 1, wherein the aperture tool is safely operable at high temperatures.

8. The aperture tool of claim 1, further comprising an attachment on the top of the housing to raise and lower the tool in and out of the landfill gas recovery well.

9. An aperture tool for producing landfill gas from the pipe of a landfill gas recovery well comprising a housing with a cavity inside the housing;

a first piston positioned within the cavity having and outer end capable of extending through an opening in the housing sized to receive the outer end of the piston;

a second piston positioned within the cavity having an outer end capable of extending through an opening in the housing sized to receive the outer end of the piston;

the first piston has an internal enlarged end and the second piston has and internal enlarged end, the first piston and the second piston are spaced approximately 180 degrees apart with the internal ends adjacent to each other;

each of the first piston and the second piston with an enlarged end opposite said outer end that contacts an internal wall of the cavity at the respective opening in the housing providing stops to prevent a piston from sliding out of the cavity;

a first bore in the housing for providing a channel for flow of motive fluid into and out of the cavity so that when motive fluid is introduced into the cavity via the first bore it provides pressure to the internal ends of the first piston and the second piston and pushes the outer end of the first piston and the outer end of the second piston through the opening in the housing with sufficient force to create apertures through the pipe of the landfill recovery well; and a second bore in the housing for providing a channel for flow of motive fluid into and out of the cavity so that when motive fluid is introduced into the cavity via the second bore it provides pressure to the first piston and the second piston and retracts the outer end of the first piston and the second piston through the opening in the housing, wherein the housing is generally spherical in shape.

10. The aperture tool of claim 9, wherein the first piston and the second piston comprise an enlarged portion spaced from the outer end of the piston providing a stop to prevent the piston from sliding out of the housing.

11. The aperture tool of claim 9, wherein the aperture created in the pipe of the landfill gas recovery well ranges from about ¼ inch to about 1 inch in diameter.

12. The aperture tool of claim 9, further comprising a carrier to transport the tool to the landfill gas recovery well.

13. The aperture tool of claim 9, wherein the motive fluid supplies pressure ranging from about 1000 to about 3500 psi.

14. The aperture tool of claim 9, wherein the aperture tool is safely operable above or within landfill fluids selected from water, leachate, corrosive condensate, and explosive ranges of the landfill gases.

15. The aperture tool of claim 9, wherein the aperture tool is safely operable at high temperatures.

16. The aperture tool of claim 9, further comprising an attachment mechanism on the top of the housing to provide an attachment to raise and lower the tool in and out of the landfill gas recovery well.

* * * * *